US010260151B2

(12) United States Patent
Shinozaki et al.

(10) Patent No.: US 10,260,151 B2
(45) Date of Patent: Apr. 16, 2019

(54) TREATMENT LIQUID FOR TRIVALENT CHROMIUM CONVERSION COATING AND TREATMENT METHOD OF METAL SUBSTRATE

(71) Applicant: Nippon Hyomen Kagaku Kabushiki Kaisha, Tokyo (JP)

(72) Inventors: Kazuyuki Shinozaki, Chigasaki (JP); Mitsuomi Katori, Chigasaki (JP); Hiroyuki Kaneta, Chigasaki (JP)

(73) Assignee: Nippon Hyomen Kagaku Kabushiki Kaisha, Tokyo (JP)

( * ) Notice: Subject to any disclaimer, the term of this patent is extended or adjusted under 35 U.S.C. 154(b) by 407 days.

(21) Appl. No.: 14/957,907

(22) Filed: Dec. 3, 2015

(65) Prior Publication Data

US 2016/0208391 A1 Jul. 21, 2016

(30) Foreign Application Priority Data

Jan. 16, 2015 (JP) ..... 2015-006572

(51) Int. Cl.

| | |
|---|---|
| ***C23C 22/30*** | (2006.01) |
| ***C23C 22/53*** | (2006.01) |
| ***C23C 22/40*** | (2006.01) |
| ***C23C 22/46*** | (2006.01) |
| ***C23C 22/73*** | (2006.01) |

(52) U.S. Cl.

CPC ..... *C23C 22/53* (2013.01); *C23C 22/40* (2013.01); *C23C 22/46* (2013.01); *C23C 22/73* (2013.01); *C23C 2222/10* (2013.01)

(58) Field of Classification Search

CPC ..... C23C 2222/10

See application file for complete search history.

(56) References Cited

U.S. PATENT DOCUMENTS

| | | | | |
|---|---|---|---|---|
| 7,294,362 | B2 | 11/2007 | Tanaka et al. | |
| 8,337,641 | B2 | 12/2012 | Yamamoto et al. | |
| 2003/0148122 | A1 | 8/2003 | Oshima et al. | |
| 2003/0207133 | A1 | 11/2003 | Preikschat et al. | |
| 2005/0103229 | A1* | 5/2005 | Tanaka | C09D 5/12 106/162.2 |

FOREIGN PATENT DOCUMENTS

| | | | |
|---|---|---|---|
| CN | 1615375 | A | 5/2005 |
| CN | 102011112 | A | 11/2012 |
| EP | 1944390 | A1 | 7/2008 |
| EP | 2 759 621 | A1 | 7/2014 |
| JP | 2000/509434 | A | 7/2000 |
| JP | 2003/166074 | A | 6/2003 |
| JP | 2005/240068 | A | 9/2005 |
| JP | 2007/321234 | A | 12/2007 |
| JP | 2014/159627 | A | 9/2014 |

OTHER PUBLICATIONS

Extended European Search Report in EP Application No. 16150100.2 dated Jun. 16, 2016, 5 pages.

Office Action in CN Application No. 201510881507.7 dated Nov. 5, 2018, 54 pages, including cited references.

* cited by examiner

*Primary Examiner* — Lois L Zheng

(74) *Attorney, Agent, or Firm* — Marshall, Gerstein & Borun LLP

(57) ABSTRACT

Provided are a treatment liquid for a trivalent chromium conversion coating, achieving excellent corrosion resistance and scratch resistance without containing a cobalt compound, with high stability and adequate consideration for environmental issues; and a method for treating a metal substrate using the same. Provided is a treatment liquid for a trivalent chromium conversion coating on the surface of a metal substrate comprising: a trivalent chromium compound; titanium lactate; one or more compounds of transition metal other than cobalt; two or more organic acids or organic acid salts, and at least one ion species selected from chloride ions, nitrate ions, and sulfate ions; but no cobalt compound.

3 Claims, No Drawings

TREATMENT LIQUID FOR TRIVALENT CHROMIUM CONVERSION COATING AND TREATMENT METHOD OF METAL SUBSTRATE

BACKGROUND OF THE INVENTION

Field of the Invention

The present invention relates to a treatment liquid for a trivalent chromium conversion coating and a treatment method of a metal substrate.

Description of the Related Art

In general, zinc or zinc alloy plating is widely used as a method for rust prevention of iron materials and iron parts. Zinc is, however, a metal to rust easily, so that the direct use thereof immediately causes the occurrence of white rust, which is the rust of zinc. Accordingly, formation of a further protective coating is commonly required.

In the field of conversion coating treatment to form a protective layer, hexavalent chromating used to be frequently employed. Due to environmental problems, however, trivalent chromium conversion coating is mainly used at the present time. The art related to the field is described in prior literature such as Japanese Patent Laid-Open No. 2000-509434, Japanese Patent Laid-Open No. 2005-240068.

A treatment liquid for a trivalent chromium conversion coating for zinc or zinc alloy plating typically contains a cobalt compound in order to improve the corrosion resistance. Japanese Patent Laid-Open No. 2000-509434, Japanese Patent Laid-Open No. 2003-166074, Japanese Patent Laid-Open No. 2007-321234, Japanese Patent Laid-Open No. 2005-240068.

However, the influence of cobalt compounds on environment has been indicated. A part of cobalt compounds are already registered on the SVHC (Substance of Very High Concern) list of REACH (Registration, Evaluation, Authorization and Restriction of Chemicals) regulations. Other cobalt-containing compounds are also registered in the same way. In Japan, measures for use of cobalt have been enhanced by Industrial Safety and Health Law Enforcement Ordinance and Ordinance on Prevention of Hazards due to Specified Chemical Substances. Accordingly, use of a cobalt compound contained in the treatment liquid for a black trivalent chromium conversion coating may be also restricted in the future.

A treatment liquid for a trivalent chromium conversion coating with addition of a titanium compound instead of a cobalt compound is described in Japanese Patent Laid-Open No. 2014-159627. The titanium compound-containing treatment liquid for a trivalent chromium conversion coating described in the literature, however, has a problem that the stability of the treatment liquid, the corrosion resistance, and the appearance are hardly obtained in the conversion coating treatment in an actual production.

In view of the foregoing problem, it is an object of the present invention to provide: a treatment liquid for a trivalent chromium conversion coating, achieving excellent corrosion resistance and scratch resistance without containing a cobalt compound, with high stability; and a method for treating a metal substrate using the same.

SUMMARY OF THE INVENTION

The present inventor has found the following means as a result of intensive studies. Namely, no cobalt compound to improve the corrosion resistance is used in a treatment liquid for a trivalent chromium conversion coating, so as to improve the stability of the treatment liquid and deal with environmental issues. The present inventor has found that a treatment liquid for a trivalent chromium conversion coating prepared by using a prescribed titanium compound instead of a cobalt compound can achieve a treatment excellent in the corrosion resistance, the scratch resistance, and the stability of the treatment liquid, so as to solve the problem.

An aspect of the present invention accomplished based on the findings described above relates to a treatment liquid for a conversion coating on the surface of a metal substrate, more specifically, relates to a treatment liquid for a trivalent chromium conversion coating which contains a trivalent chromium compound, titanium lactate, compounds of one or more transition metals except for cobalt, two or more organic acids or organic acid salts, and at least one ion species selected from chloride ions, nitrate ions, and sulfate ions, and contains no cobalt compound.

In an embodiment, the treatment liquid for a trivalent chromium conversion coating of the present invention contains no water-dispersible silica.

In another embodiment of the treatment liquid for a trivalent chromium conversion coating of the present invention, the metal substrate is a zinc plated or zinc-alloy plated material.

Another aspect of the present invention relates to a method for treating a metal substrate, including immersing a metal substrate in the treatment liquid for a trivalent chromium conversion coating of the present invention so as to form a trivalent chromium conversion coating on the surface of the metal substrate.

The present invention provides a treatment liquid for a trivalent chromium conversion coating, achieving excellent corrosion resistance and scratch resistance without containing a cobalt compound, with high stability and adequate consideration for environmental issues; and a method for treating a metal substrate using the same.

DETAILED DESCRIPTION OF THE PREFERRED EMBODIMENTS (Treatment Liquid for Black Trivalent Chromium Conversion Coating)

The treatment liquid for a trivalent chromium conversion coating of the present invention is a treatment liquid for conversion coating on the surface of a metal substrate, which contains a trivalent chromium compound, titanium lactate, compounds of one or more transition metals except for cobalt, two or more organic acids or organic acid salts, and at least one ion species selected from chloride ions, nitrate ions, and sulfate ions, and contains no cobalt compound. The metal substrate is preferably a zinc plated or zinc-alloy plated material, though not particularly limited.

The type of the trivalent chromium compound is not particularly limited, and a trivalent chromium salt such as chromium nitrate, chromium sulfate, and chromium phosphate may be used. The concentration of chromium in the treatment liquid for a trivalent chromium conversion coating is not particularly limited, preferably in a range of 0.1 g/L to 100 g/L, more preferably in a range of 0.5 to 10 g/L.

One titanium compound used to substitute for a cobalt compound is titanium lactate. Although the corrosion resistance may be obtained with use of other titanium compounds, the stability, the corrosion resistance and the appearance are worsened in an actual conversion coating treatment. Further, depending on the type of the titanium compound, compounds of fluorine, phosphorus, and the like with high burden on the environment are often included for stabilization. In the case of using titanium lactate, the stability, the corrosion resistance and the appearance are sufficiently obtained in an actual conversion coating treatment, and the burden on the environment is reduced due to containing no fluorine, phosphorus, and the like. Although the concentration of titanium lactate in the treatment liquid for a trivalent chromium conversion coating is not particularly limited, preferably in a range of 0.0001 to 100 g/L, more preferably 0.0001 to 10 g/L.

With use of titanium lactate, the excellent stability, the corrosion resistance, and the scratch resistance can be obtained, and the addition of one or more compounds of transition metals further improves the corrosion resistance, the appearance, and the scratch resistance. Although a conventional conversion coating using a cobalt compound is excellent in the scratch resistance as well as the corrosion resistance in many cases, the scratch resistance as well as the corrosion resistance can be similarly obtained by using titanium lactate together with one or more types of compounds of transition metals other than cobalt. Examples of the transition metal compound include a salt of zirconium, tungsten, vanadium, cerium, manganese, or nickel. The concentration of each metal ion in the treatment liquid for a trivalent chromium conversion coating is not particularly limited, preferably 0.1 to 100 g/L, more preferably 0.1 to 10 g/L.

Although the two or more organic acids or organic acid salts are not particularly limited, preferably at least one of the organic acids or organic acid salts, more preferably two or more of the organic acids or organic acid salts, are polycarboxylic acids having a molecular weight of 500 or less including an organic acid such as malonic acid, tartaric acid, citric acid, malic acid, lactic acid, succinic acid, gluconic acid, glutamic acid, diglycolic acid, ascorbic acid, and oxalic acid, or a salt thereof. In particular, use of malonic acid or a salt of malonic acid, or use of oxalic acid or a salt of oxalic acid, in combination of another organic acid tends to exhibit both of high corrosion resistance and an excellent appearance. Although the concentration of the organic acid ions in the treatment liquid for a trivalent chromium conversion coating is not particularly limited, the total of the organic acid ions in a range of 0.1 g/L to 100 g/L is preferred, and the total in a range of 1 g/L to 30 g/L is more preferred. With an excessively low concentration of organic acid ions, a problem of non-uniform appearance such as color variability may occur during long-term use (and due to an increased amount of impurities). With an excessively high concentration of the organic acid ions, economical disadvantage may be caused with little harmful effects.

Chloride ions, nitrate ions, and sulfate ions are typically provided in the form of hydrochloric acid, nitric acid and sulfuric acid, respectively, or a metal salt thereof such as a sodium salt and a potassium salt, and the concentration of the total ions in the treatment liquid for a trivalent chromium conversion coating is not particularly limited, preferably in the range of 0.1 to 100 g/L, more preferably 1 to 30 g/L. The chlorine ions, nitrate ions and sulfate ions function as a film-forming component to form a uniform conversion coating having a certain degree of thickness.

In order to clean or activate the plated surface of a metal substrate, a pretreatment for forming a conversion coating may be performed using a treatment liquid which contains a surfactant, inorganic acid ions, hydroxide, metal ions and the like. Further, an overcoating or painting may be applied after formation of a conversion coating in consideration of the corrosion resistance and the appearance. The concentrations thereof are not particularly limited.

However, water-dispersible silica such as sodium silicate or colloidal silica is preferably not used in the treatment of the conversion coating formed by the treatment method of the present invention, in order to avoid the worsening of the appearance and the stability of the treatment liquid.

When a metal substrate such as a zinc plated or zinc alloy plated material is immersed in a treatment liquid for a trivalent chromium conversion coating so as to form a trivalent chromium conversion coating, the treatment temperature, the pH, and the treatment time in the conversion coating treatment are not particularly limited, and preferably the treatment is performed at a treatment temperature of 20 to 50° C., at a pH of 1.0 to 3.0, in a treatment time of 20 to 90 seconds. With an excessively high temperature, the coating tends to be clouded. With an excessively low temperature, a sufficient coating may not be formed. With a higher pH, an insufficient amount of coating may be formed due to the lack of etching. With a shorter treatment time, a sufficient amount of coating is not formed. With a treatment time of over 90 seconds, the productivity may be lowered without enough effects.

(Treatment Method of Metal Substrate)

The treatment method of a metal substrate of the present invention includes the step of immersing a metal substrate made of zinc plated or zinc-alloy plated material or the like in the treatment liquid for a trivalent chromium conversion coating so as to form the trivalent chromium conversion coating on the surface of the metal substrate. The treatment method allows the coating of a metal substrate which has excellent corrosion resistance and scratch resistance and no cobalt compound to be formed using a treatment liquid having high stability.

EXAMPLES

The present invention is further described in detail in the following with reference to Examples of the present invention. The present invention is, however, not limited to the Examples listed below.

In the following, the present invention is described with reference to Examples mainly for zinc plating on which the present invention has the most significant effects. In a testing, a specimen was first subjected to an appropriate pretreatment such as degreasing and immersing in acid. Zinc plating (HYPERZINC, manufactured by Nippon Hyomen Kagaku K.K.) was applied to the pretreated specimen, which was then immersed in nitric acid with a low concentration as an appropriate treatment. Subsequently the specimen was subjected to a treatment with a treatment liquid for a trivalent chromium conversion coating. The pH adjustment of the treatment liquid was performed by an appropriate acid selected from sulfuric acid, nitric acid, and hydrochloric acid, and sodium hydroxide.

The film thickness of the plating was controlled at 8 to 10 μm. The evaluation of corrosion resistance was performed based on a salt spray testing in accordance with JIS Z 2371. The evaluation of scratch resistance was performed based on a salt spray testing in accordance with JIS Z 2371 for the specimens scratched in an X-shape with a cutter knife after the treatment. The corrosion resistance and the scratch resistance in the salt spray testing were confirmed using 5 or 10 pieces of the specimens for each condition. On this occasion, the state at a specified time was evaluated as follows: "circle: no occurrence of corrosion in all the specimens", "triangle: occurrence of corrosion in a part of the specimens", and "X-mark: occurrence of corrosion in all the specimens".

The stability of each treatment liquid was evaluated by confirming the occurrence of precipitation or turbidity in the liquid left standing after the treatment. The evaluation criteria for the stability are as follows: "circle: no occurrence of precipitation and turbidity".

Example 1

A zinc-plated iron plate (surface area: 1 $dm^2$) was immersed in a treatment liquid for a trivalent chromium conversion coating, which contains chromium nitrate with a chromium content of 3 g/L, titanium lactate with a titanium content of 1 g/L, ammonium vanadate with a vanadium content of 3 g/L, and 5 g/L of malonic acid and 5 g/L of oxalic acid as organic acids, with addition of sodium nitrate to have a nitrate content of 20 g/L, controlled to a temperature of 30° C. and a pH of 2.0, for 30 seconds. Subsequently the corrosion resistance, the scratch resistance, and the appearance thereof were evaluated. Further, the stability of the treatment liquid after left standing at room temperature for 48 hours was evaluated by performing the testing for the second time at that point for evaluation of the corrosion resistance, the scratch resistance, and the appearance.

Examples 2 to 5

Using one of the transition metal compounds described in Table 1 instead of vanadium in Example 1, the testing was performed under the same conditions as in Example 1.

TABLE 1

| | |
|---|---|
| Example 2 | Nickel sulfate |
| Example 3 | Cerium nitrate |
| Example 4 | Manganese sulfate |
| Example 5 | Sodium molybdate |

Examples 6 to 16

Using one of the organic acids described in Table 2 instead of oxalic acid in Example 1, the testing was performed under the same conditions as in Example 1.

TABLE 2

| | |
|---|---|
| Example 6 | Tartaric acid |
| Example 7 | Citric acid |
| Example 8 | Malic acid |
| Example 9 | Succinic acid |
| Example 10 | Gluconic acid |
| Example 11 | Glutamic acid |
| Example 12 | Glycolic acid |
| Example 13 | Diglycolic acid |
| Example 14 | Ascorbic acid |
| Example 15 | Acetic acid |
| Example 16 | Butyric acid |

Examples 17 to 27

Using one of the organic acids described in Table 3 instead of malonic acid in Example 1, the testing was performed under the same conditions as in Example 1.

TABLE 3

| | |
|---|---|
| Example 17 | Tartaric acid |
| Example 18 | Citric acid |
| Example 19 | Malic acid |
| Example 20 | Succinic acid |
| Example 21 | Gluconic acid |
| Example 22 | Glutamic acid |
| Example 23 | Glycolic acid |
| Example 24 | Diglycolic acid |
| Example 25 | Ascorbic acid |
| Example 26 | Acetic acid |
| Example 27 | Butyric acid |

Examples 28 to 37

The concentration conditions each in the treatment liquid for a conversion coating in Example 1 were changed to those described in Table 4 for the testings.

TABLE 4

| | Chromium [g/L] | Titanium [g/L] | Vanadium [g/L] | Malonic acid [g/L] | Oxalic acid [g/L] | Nitrate [g/L] |
|---|---|---|---|---|---|---|
| Example 1 | 3 | 1 | 3 | 5 | 5 | 20 |
| Example 28 | 0.5 | 1 | 3 | 5 | 5 | 20 |
| Example 29 | 10 | 1 | 3 | 5 | 5 | 20 |
| Example 30 | 1 | 0.5 | 1 | 1 | 1 | 10 |
| Example 31 | 1 | 0.5 | 0.5 | 0.5 | 0.5 | 5 |
| Example 32 | 3 | 1 | 3 | 5 | 5 | 1 |
| Example 33 | 3 | 5 | 3 | 5 | 5 | 20 |
| Example 34 | 3 | 5 | 5 | 5 | 5 | 20 |
| Example 35 | 3 | 1 | 5 | 5 | 5 | 20 |
| Example 36 | 8 | 5 | 5 | 10 | 10 | 30 |
| Example 37 | 8 | 1 | 3 | 20 | 5 | 20 |

Examples 38 to 41

In Examples 38 to 41, each of the pH in Example 1 was changed to ph 1.5 (Example 38), pH 2.0 (Example 39), pH 2.5 (Example 40), or pH 3.0 (Example 41).

Examples 42 to 44

In Examples 42 to 44, each of the temperature in Example 1 was changed to 20° C. (Example 42), 40° C. (Example 43), and 50° C. (Example 44).

Examples 45 to 47

In Examples 45 to 47, each of the treatment time in Example 1 was changed to 20 seconds (Example 45), 60 seconds (Example 46), and 90 seconds (Example 47).

Comparative Example 1

In Comparative Example 1, a zinc alloy-plated iron plate (surface area: 1 $dm^2$) was immersed in a commercially available treatment liquid for a trivalent chromium conversion coating for zinc alloy plating (TR-173A (product name), manufactured by Nippon Hyomen Kagaku K. K., containing trivalent chromium, nitrate ions, an organic acid and cobalt, and containing no titanium and no other transition metal compound. TR-173A: 200 mL/L) controlled to a temperature of 30° C. and a pH of 2.0, for 60 seconds, so as to form a trivalent chromium conversion coating. Subsequently the corrosion resistance, the scratch resistance, and the appearance thereof were evaluated.

Comparative Example 2

In Comparative Example 2, except that a treatment liquid for a black trivalent chromium conversion coating excluding titanium lactate was used, the testing was performed under the same conditions as in Example 1.

Comparative Examples 3 to 7

In Comparative Examples 3 to 7, except that titanium lactate was substituted with one of the titanium compound described in Table 5, the testing was performed under the same conditions as in Example 1.

TABLE 5

| | |
|---|---|
| Comparative Example 3 | Titanium (IV) sulfate |
| Comparative Example 4 | Titanium (IV) oxide |
| Comparative Example 5 | Titanium (IV) chloride |
| Comparative Example 6 | Ammonium fluorotitanate |
| Comparative Example 7 | Potassium fluorotitanate |

Comparative Example 8

In Comparative Example 8, except that a treatment liquid for a black trivalent chromium conversion coating excluding ammonium vanadate was used, the testing was performed under the same conditions as in Example 1.

Comparative Example 9

In Comparative Example 9, except that a treatment liquid for a black trivalent chromium conversion coating excluding titanium lactate and ammonium vanadate was used, the testing was performed under the same conditions as in Example 1.

Comparative Examples 10 to 20

In Comparative Examples 10 to 20, except that malonic acid in Comparative Example 9 was substituted with one of the organic acids described in Table 6, the testing was performed under the same conditions as in Comparative Example 9.

TABLE 6

| | |
|---|---|
| Comparative Example 10 | Tartaric acid |
| Comparative Example 11 | Citric acid |
| Comparative Example 12 | Malic acid |
| Comparative Example 13 | Succinic acid |
| Comparative Example 14 | Gluconic acid |
| Comparative Example 15 | Glutamic acid |
| Comparative Example 16 | Glycolic acid |
| Comparative Example 17 | Diglycolic acid |
| Comparative Example 18 | Ascorbic acid |
| Comparative Example 19 | Acetic acid |
| Comparative Example 20 | Butyric acid |

The evaluation results of the appearance, the corrosion resistance, and the scratch resistance in Examples 1 to 47 and Comparative Examples 1 to 20 are described in Table 7.

TABLE 7

| | Appearance | Corrosion resistance (168 h) | Corrosion resistance (240 h) | Scratch resistance (168 h) | Scratch resistance (240 h) |
|---|---|---|---|---|---|
| Example 1 | Uniform glossy appearance | ○ | ○ | ○ | ○ |
| Example 2 | Uniform glossy appearance | ○ | ○ | ○ | ○ |
| Example 3 | Uniform glossy appearance | ○ | ○ | ○ | ○ |
| Example 4 | Uniform glossy appearance | ○ | ○ | ○ | ○ |
| Example 5 | Uniform glossy appearance | ○ | ○ | ○ | ○ |
| Example 6 | Uniform glossy appearance | ○ | Δ | Δ | Δ |
| Example 7 | Uniform glossy appearance | ○ | ○ | ○ | ○ |
| Example 8 | Uniform glossy appearance | ○ | ○ | ○ | ○ |
| Example 9 | Uniform glossy appearance | ○ | ○ | ○ | ○ |
| Example 10 | Uniform glossy appearance | ○ | ○ | ○ | ○ |
| Example 11 | Uniform glossy appearance | ○ | ○ | ○ | ○ |
| Example 12 | Uniform glossy appearance | ○ | ○ | ○ | ○ |
| Example 13 | Uniform glossy appearance | ○ | ○ | ○ | ○ |
| Example 14 | Uniform glossy appearance | ○ | ○ | ○ | ○ |
| Example 15 | Uniform glossy appearance | ○ | ○ | ○ | ○ |
| Example 16 | Uniform glossy appearance | ○ | ○ | ○ | ○ |
| Example 17 | Uniform glossy appearance | ○ | ○ | ○ | ○ |
| Example 18 | Uniform glossy appearance | ○ | ○ | ○ | ○ |
| Example 19 | Uniform glossy appearance | ○ | ○ | ○ | ○ |
| Example 20 | Uniform glossy appearance | ○ | ○ | ○ | ○ |
| Example 21 | Uniform glossy appearance | ○ | ○ | ○ | ○ |
| Example 22 | Uniform glossy appearance | ○ | ○ | ○ | ○ |
| Example 23 | Uniform glossy appearance | ○ | ○ | ○ | ○ |
| Example 24 | Uniform glossy appearance | ○ | ○ | ○ | ○ |
| Example 25 | Uniform glossy appearance | ○ | ○ | ○ | ○ |
| Example 26 | Uniform glossy appearance | ○ | ○ | ○ | ○ |
| Example 27 | Uniform glossy appearance | ○ | ○ | ○ | ○ |
| Example 28 | Uniform glossy appearance | ○ | Δ | ○ | Δ |
| Example 29 | Uniform glossy appearance | ○ | ○ | ○ | ○ |
| Example 30 | Uniform glossy appearance | ○ | ○ | ○ | Δ |
| Example 31 | Uniform glossy appearance | ○ | Δ | Δ | Δ |
| Example 32 | Uniform glossy appearance | ○ | ○ | ○ | ○ |

TABLE 7-continued

| | Appearance | Corrosion resistance (168 h) | Corrosion resistance (240 h) | Scratch resistance (168 h) | Scratch resistance (240 h) |
|---|---|---|---|---|---|
| Example 33 | Uniform glossy appearance | ○ | ○ | ○ | ○ |
| Example 34 | Uniform glossy appearance | ○ | ○ | ○ | ○ |
| Example 35 | Uniform glossy appearance | ○ | ○ | ○ | ○ |
| Example 36 | Uniform glossy appearance | ○ | ○ | ○ | ○ |
| Example 37 | Uniform glossy appearance | ○ | ○ | ○ | ○ |
| Example 38 | Uniform glossy appearance | ○ | ○ | ○ | ○ |
| Example 39 | Uniform glossy appearance | ○ | ○ | ○ | ○ |
| Example 40 | Uniform glossy appearance | ○ | ○ | ○ | ○ |
| Example 41 | Uniform glossy appearance | ○ | ○ | ○ | ○ |
| Example 42 | Uniform glossy appearance | ○ | ○ | ○ | ○ |
| Example 43 | Uniform glossy appearance | ○ | ○ | ○ | ○ |
| Example 44 | Slightly non-uniform appearance | ○ | ○ | ○ | ○ |
| Example 45 | Uniform glossy appearance | ○ | ○ | ○ | ○ |
| Example 46 | Uniform glossy appearance | ○ | ○ | ○ | ○ |
| Example 47 | Uniform glossy appearance | ○ | ○ | ○ | ○ |
| Comparative Example 1 | Uniform glossy appearance | ○ | ○ | ○ | ○ |
| Comparative Example 2 | Uniform glossy appearance | Δ | x | x | x |
| Comparative Example 3 | Uniform glossy appearance | ○ | ○ | ○ | ○ |
| Comparative Example 4 | Uniform glossy appearance | ○ | ○ | ○ | ○ |
| Comparative Example 5 | Uniform glossy appearance | ○ | ○ | ○ | ○ |
| Comparative Example 6 | Uniform glossy appearance | ○ | ○ | ○ | ○ |
| Comparative Example 7 | Uniform glossy appearance | ○ | ○ | ○ | ○ |
| Comparative Example 8 | Uniform glossy appearance | ○ | Δ | Δ | x |
| Comparative Example 9 | Uniform glossy appearance | x | x | x | x |
| Comparative Example 10 | Uniform glossy appearance | x | x | x | x |
| Comparative Example 11 | Uniform glossy appearance | x | x | x | x |
| Comparative Example 12 | Uniform glossy appearance | x | x | x | x |
| Comparative Example 13 | Uniform glossy appearance | x | x | x | x |
| Comparative Example 14 | Uniform glossy appearance | x | x | x | x |
| Comparative Example 15 | Uniform glossy appearance | x | x | x | x |
| Comparative Example 16 | Uniform glossy appearance | x | x | x | x |
| Comparative Example 17 | Uniform glossy appearance | x | x | x | x |
| Comparative Example 18 | Uniform glossy appearance | x | x | x | x |
| Comparative Example 19 | Uniform glossy appearance | x | x | x | x |
| Comparative Example 20 | Uniform glossy appearance | x | x | x | x |

After the treatment liquid was left standing for 48 hours, the appearance, the corrosion resistance, and the scratch resistance were evaluated in Examples 1 to 47 and Comparative Examples 1 to 20. The evaluation results are described in Table 8.

TABLE 8

| | Appearance | Stability of treatment liquid | Corrosion resistance (168 h) | Corrosion resistance (240 h) | Scratch resistance (168 h) | Scratch resistance (240 h) |
|---|---|---|---|---|---|---|
| Example 1 | Uniform glossy appearance | ○ | ○ | ○ | ○ | ○ |
| Example 2 | Uniform glossy appearance | ○ | ○ | ○ | ○ | Δ |
| Example 3 | Uniform glossy appearance | ○ | ○ | ○ | ○ | Δ |
| Example 4 | Uniform glossy appearance | ○ | ○ | ○ | ○ | Δ |
| Example 5 | Uniform glossy appearance | ○ | ○ | ○ | ○ | Δ |
| Example 6 | Uniform glossy appearance | ○ | ○ | ○ | ○ | ○ |

TABLE 8-continued

| | Appearance | Stability of treatment liquid | Corrosion resistance (168 h) | Corrosion resistance (240 h) | Scratch resistance (168 h) | Scratch resistance (240 h) |
|---|---|---|---|---|---|---|
| Example 7 | Uniform glossy appearance | ○ | ○ | ○ | ○ | ○ |
| Example 8 | Uniform glossy appearance | ○ | ○ | ○ | ○ | ○ |
| Example 9 | Uniform glossy appearance | ○ | ○ | ○ | ○ | ○ |
| Example 10 | Uniform glossy appearance | ○ | ○ | ○ | ○ | ○ |
| Example 11 | Uniform glossy appearance | ○ | ○ | ○ | ○ | ○ |
| Example 12 | Uniform glossy appearance | ○ | ○ | ○ | ○ | ○ |
| Example 13 | Uniform glossy appearance | ○ | ○ | ○ | ○ | ○ |
| Example 14 | Uniform glossy appearance | ○ | ○ | ○ | ○ | ○ |
| Example 15 | Uniform glossy appearance | ○ | ○ | ○ | ○ | ○ |
| Example 16 | Uniform glossy appearance | ○ | ○ | ○ | ○ | ○ |
| Example 17 | Uniform glossy appearance | ○ | ○ | ○ | ○ | ○ |
| Example 18 | Uniform glossy appearance | ○ | ○ | ○ | ○ | ○ |
| Example 19 | Uniform glossy appearance | ○ | ○ | ○ | ○ | ○ |
| Example 20 | Uniform glossy appearance | ○ | ○ | ○ | ○ | ○ |
| Example 21 | Uniform glossy appearance | ○ | ○ | ○ | ○ | ○ |
| Example 22 | Uniform glossy appearance | ○ | ○ | ○ | ○ | ○ |
| Example 23 | Uniform glossy appearance | ○ | ○ | ○ | ○ | ○ |
| Example 24 | Uniform glossy appearance | ○ | ○ | ○ | ○ | ○ |
| Example 25 | Uniform glossy appearance | ○ | ○ | ○ | ○ | ○ |
| Example 26 | Uniform glossy appearance | ○ | ○ | ○ | ○ | ○ |
| Example 27 | Uniform glossy appearance | ○ | ○ | ○ | ○ | ○ |
| Example 28 | Uniform glossy appearance | ○ | ○ | Δ | ○ | Δ |
| Example 29 | Uniform glossy appearance | ○ | ○ | ○ | ○ | ○ |
| Example 30 | Uniform glossy appearance | ○ | ○ | ○ | ○ | Δ |
| Example 31 | Uniform glossy appearance | ○ | ○ | Δ | Δ | Δ |
| Example 32 | Uniform glossy appearance | ○ | ○ | ○ | ○ | ○ |
| Example 33 | Uniform glossy appearance | ○ | ○ | ○ | ○ | ○ |
| Example 34 | Uniform glossy appearance | ○ | ○ | ○ | ○ | ○ |
| Example 35 | Uniform glossy appearance | ○ | ○ | ○ | ○ | ○ |
| Example 36 | Uniform glossy appearance | ○ | ○ | ○ | ○ | ○ |
| Example 37 | Uniform glossy appearance | ○ | ○ | ○ | ○ | ○ |
| Example 38 | Uniform glossy appearance | ○ | ○ | ○ | ○ | ○ |
| Example 39 | Uniform glossy appearance | ○ | ○ | ○ | ○ | ○ |
| Example 40 | Uniform glossy appearance | ○ | ○ | ○ | ○ | ○ |
| Example 41 | Uniform glossy appearance | ○ | ○ | ○ | ○ | ○ |
| Example 42 | Uniform glossy appearance | ○ | ○ | ○ | ○ | ○ |
| Example 43 | Uniform glossy appearance | ○ | ○ | ○ | ○ | ○ |
| Example 44 | Slightly non-uniform appearance | ○ | ○ | ○ | ○ | ○ |

TABLE 8-continued

| | Appearance | Stability of treatment liquid | Corrosion resistance (168 h) | Corrosion resistance (240 h) | Scratch resistance (168 h) | Scratch resistance (240 h) |
|---|---|---|---|---|---|---|
| Example 45 | Uniform glossy appearance | ○ | ○ | ○ | ○ | ○ |
| Example 46 | Uniform glossy appearance | ○ | ○ | ○ | ○ | ○ |
| Example 47 | Uniform glossy appearance | ○ | ○ | ○ | ○ | ○ |
| Comparative Example 1 | Uniform glossy appearance | ○ | ○ | ○ | ○ | ○ |
| Comparative Example 2 | Uniform glossy appearance | ○ | Δ | x | x | x |
| Comparative Example 3 | Uniform glossy appearance | Occurrence of precipitation | x | x | x | x |
| Comparative Example 4 | Uniform glossy appearance | Occurrence of precipitation | x | x | x | x |
| Comparative Example 5 | Uniform glossy appearance | Occurrence of precipitation | x | x | x | x |
| Comparative Example 6 | Uniform glossy appearance | Occurrence of precipitation | x | x | x | x |
| Comparative Example 7 | Uniform glossy appearance | Occurrence of precipitation | x | x | x | x |
| Comparative Example 8 | Uniform glossy appearance | ○ | ○ | Δ | Δ | x |
| Comparative Example 9 | Uniform glossy appearance | ○ | x | x | x | x |
| Comparative Example 10 | Uniform glossy appearance | ○ | x | x | x | x |
| Comparative Example 11 | Uniform glossy appearance | ○ | x | x | x | x |
| Comparative Example 12 | Uniform glossy appearance | ○ | x | x | x | x |
| Comparative Example 13 | Uniform glossy appearance | ○ | x | x | x | x |
| Comparative Example 14 | Uniform glossy appearance | ○ | x | x | x | x |
| Comparative Example 15 | Uniform glossy appearance | ○ | x | x | x | x |
| Comparative Example 11 | Uniform glossy appearance | ○ | x | x | x | x |
| Comparative Example 12 | Uniform glossy appearance | ○ | x | x | x | x |
| Comparative Example 13 | Uniform glossy appearance | ○ | x | x | x | x |
| Comparative Example 14 | Uniform glossy appearance | ○ | x | x | x | x |
| Comparative Example 15 | Uniform glossy appearance | ○ | x | x | x | x |
| Comparative Example 16 | Uniform glossy appearance | ○ | x | x | x | x |
| Comparative Example 17 | Uniform glossy appearance | ○ | x | x | x | x |
| Comparative Example 18 | Uniform glossy appearance | ○ | x | x | x | x |
| Comparative Example 19 | Uniform glossy appearance | ○ | x | x | x | x |
| Comparative Example 20 | Uniform glossy appearance | ○ | x | x | x | x |

In Example 1 and Comparative Example 3, 1000 sheets of zinc alloy-plated iron plates (surface area: 1 $dm^2$) were treated with each of 1 L of the treatment liquids for a trivalent chromium conversion coating, which was properly replenished. The evaluation results on the corrosion resistance, the scratch resistance, the treated appearance, and the stability of the treatment liquid after the treatment are described in Tables 9 to 11.

TABLE 9

| | Corrosion resistance (168 h) | Corrosion resistance (240 h) | Corrosion resistance (360 h) |
|---|---|---|---|
| Example 1 | ○ | ○ | ○ |
| Comparative Example 3 | x | x | x |

TABLE 10

| | Scratch resistance (168 h) | Scratch resistance (240 h) | Scratch resistance (360 h) |
|---|---|---|---|
| Example 1 | ○ | ○ | ○ |
| Comparative Example 3 | x | x | x |

TABLE 11

| | Appearance | Stability of treatment liquid |
|---|---|---|
| Example 1 | Uniform glossy appearance | ○ |
| Comparative Example 3 | Uniform glossy appearance | Occurrence of precipitation |

What is claimed is:

1. A treatment liquid for a trivalent chromium conversion coating on the surface of a metal substrate consisting of:

a trivalent chromium compound;

titanium lactate;

at least one compound of transition metal other than cobalt;

at least two organic acids or organic acid salts: and at least one ion species selected from the group consisting of chloride ions, nitrate ions, and sulfate ions, but no cobalt compound, wherein the at least two organic acids or organic acid salts are selected from the group consisting of malonic acid, tartaric acid, citric acid, malic acid, lactic acid, succinic acid, gluconic acid, glutamic acid, diglycolic acid, ascorbic acid, oxalic acid, and salts thereof.

2. The treatment liquid for a trivalent chromium conversion coating according to claim 1, wherein the metal substrate is a zinc plated or zinc-alloy plated material.

3. A method for treating a metal substrate comprising the step of:

immersing a metal substrate in the treatment liquid for a trivalent chromium conversion coating according to claim 1 to form a trivalent chromium conversion coating on the surface of the metal substrate.

* * * * *